United States Patent [19]

Eggers et al.

[11] 4,446,772

[45] May 8, 1984

[54] LARGE-BORE TWIN-WEAPON SYSTEM FOR COMBAT VEHICLES

[75] Inventors: Manfred Eggers; Armin Zonak, both of Kiel, Fed. Rep. of Germany

[73] Assignee: MaK Maschinenbau GmbH, Kiel, Fed. Rep. of Germany

[21] Appl. No.: 851,265

[22] Filed: Nov. 14, 1977

[30] Foreign Application Priority Data

Nov. 13, 1976 [DE] Fed. Rep. of Germany ..... 2651679

[51] Int. Cl.[2] ..... F41H 7/00

[52] U.S. Cl. ..... 89/37 E; 89/38; 89/41 A

[58] Field of Search ..... 89/36 H, 37 R, 37 L, 89/37 D, 37 E, 37.5 D, 37.5 E, 38, 40 R, 40 A, 40 B, 40 C, 41 R, 41 A

[56] References Cited

U.S. PATENT DOCUMENTS 1,346,794 7/1920 Muir ..... 89/37 E

FOREIGN PATENT DOCUMENTS 4896 of 1890 United Kingdom ..... 89/38

*Primary Examiner*—Stephen C. Bentley

*Attorney, Agent, or Firm*—Toren, McGeady and Stanger

[57] ABSTRACT

A large-bore twin-weapon system for combat vehicles, wherein the weapons are arranged in the proximity of the longitudinal side on the combat vehicle. The weapons are supported at the two ends of a horizontal carrier arranged therebetween unilaterally and rotatable independent of one another. The carrier is connected to the combat vehicle on three pivots. Two pivots define an axis of rotation for pivoting the carrier and the third pivot is formed as lifting means for the carrier.

5 Claims, 3 Drawing Figures

LARGE-BORE TWIN-WEAPON SYSTEM FOR COMBAT VEHICLES

BACKGROUND OF THE INVENTION

This invention relates two a large-bore twin-weapon system for combat vehicles, wherein the weapons are arranged in the proximity of the longitudinal side on the vehicle.

In conventional gun bridges for combat vehicles, the bridge case in many instances is not so distortion-free that asynchronous movement of both weapons is permitted. The oscillations of the carriage of the vehicle are transmitted to the gun bridge, and there is no oscillation decoupling between the gun bridge and the carriage. The weapons mostly are not able to be point-aimed, and the aiming of the weapons is complex.

SUMMARY OF THE INVENTION

It is the object of the present invention to avoid these prior art deficiencies, to reduce the mechanical fire loading of the gun bridge and to simplify the adjusting of the weapons.

To attain this object the present invention provides a large-bore twin-weapon system for combat vehicles, wherein the weapons are arranged in the proximity of the longitudinal side on the combat vehicle, the weapons being supported at the two ends of a horizontal carrier arranged therebetween unilaterally and rotatable independent of one another and the carrier being connected to the combat vehicle on three pivots, two pivots defining an axis of rotation for pivoting the carrier and the third pivot being formed as lifting means for the carrier.

The rotatable mounting of each weapon in the carrier is preferably effected through the intermediary of a journal in a main support bearing and a step bearing, and the journal is eccentrically adjustable in the step bearing relative to the carrier.

Advantageously, the pivots for defining the axis of rotation of the carrier may be connected to the carrier through the intermediary of support arms. These pivots may be formed resiliently.

The lifting means for the carrier may be in the form of a hydraulic cylinder. The hydraulic cylinder may further be connected to a hydro-accumulator connected upstream thereof in order to provide a resilient lifting means.

BRIEF DESCRIPTION OF THE DRAWINGS

An embodiment of the invention will now be described by way of example and with reference to the accompanying drawings, in which.

DESCRIPTION OF THE PREFERRED EMBODIMENT

Figure 1:
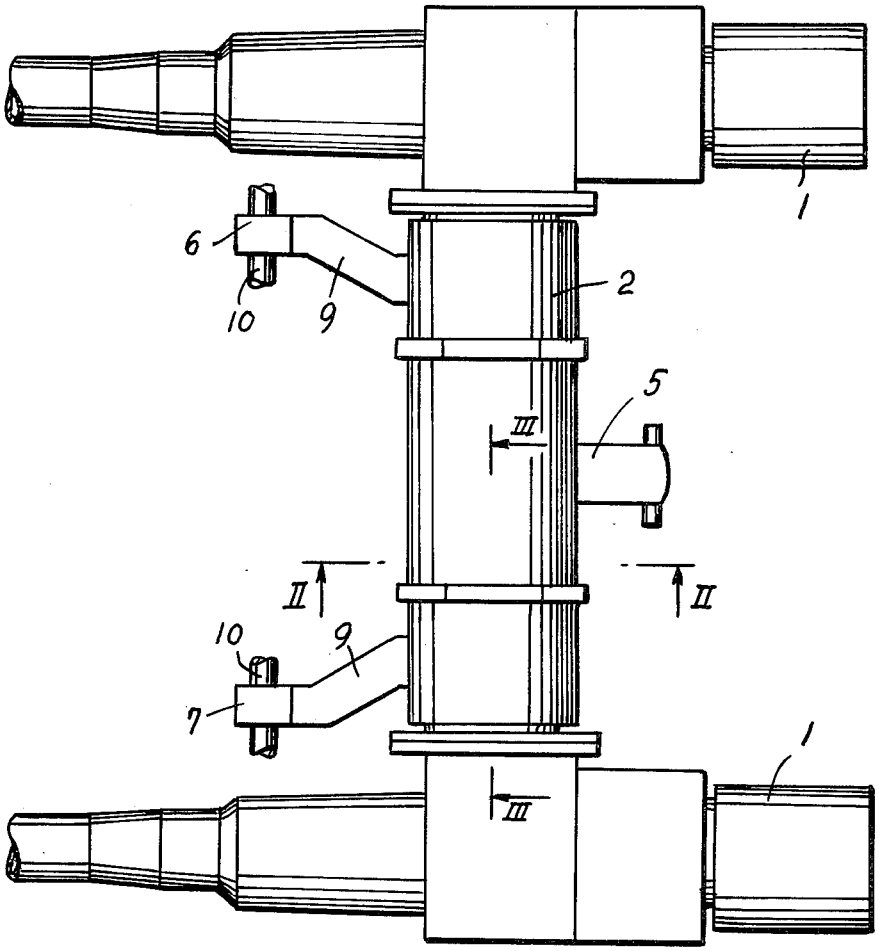
FIG. 1 is a plan view of a large-bore twin-weapon system according to the invention.

As shown in FIG. 1, a pair of weapons 1 are arranged at both ends of a horizontal carrier 2 and are supported rotatably at the carrier independent of one another. The carrier 2 is connected to a combat vehicle through the intermediary of three pivots 5, 6, 7. The two pivots 6 and 7 define an axis 10 of rotation for the pivoting of the carrier 2. The third pivot 5 is formed as lifting means for the carrier. The two weapons 1 are height-aimable independently of one another. The lateral aiming of the weapons may be effected alternatively by a rotation of the vehicle about the height axis or by a rotary device on the vehicle.

For firing (single or twin shooting), the carrier 2 may be elevated together with the weapons 1, the lifting means 5 effecting a pivoting. The firing level is thus increased by the amount the weapons 1 are lifted.

Figure 3:
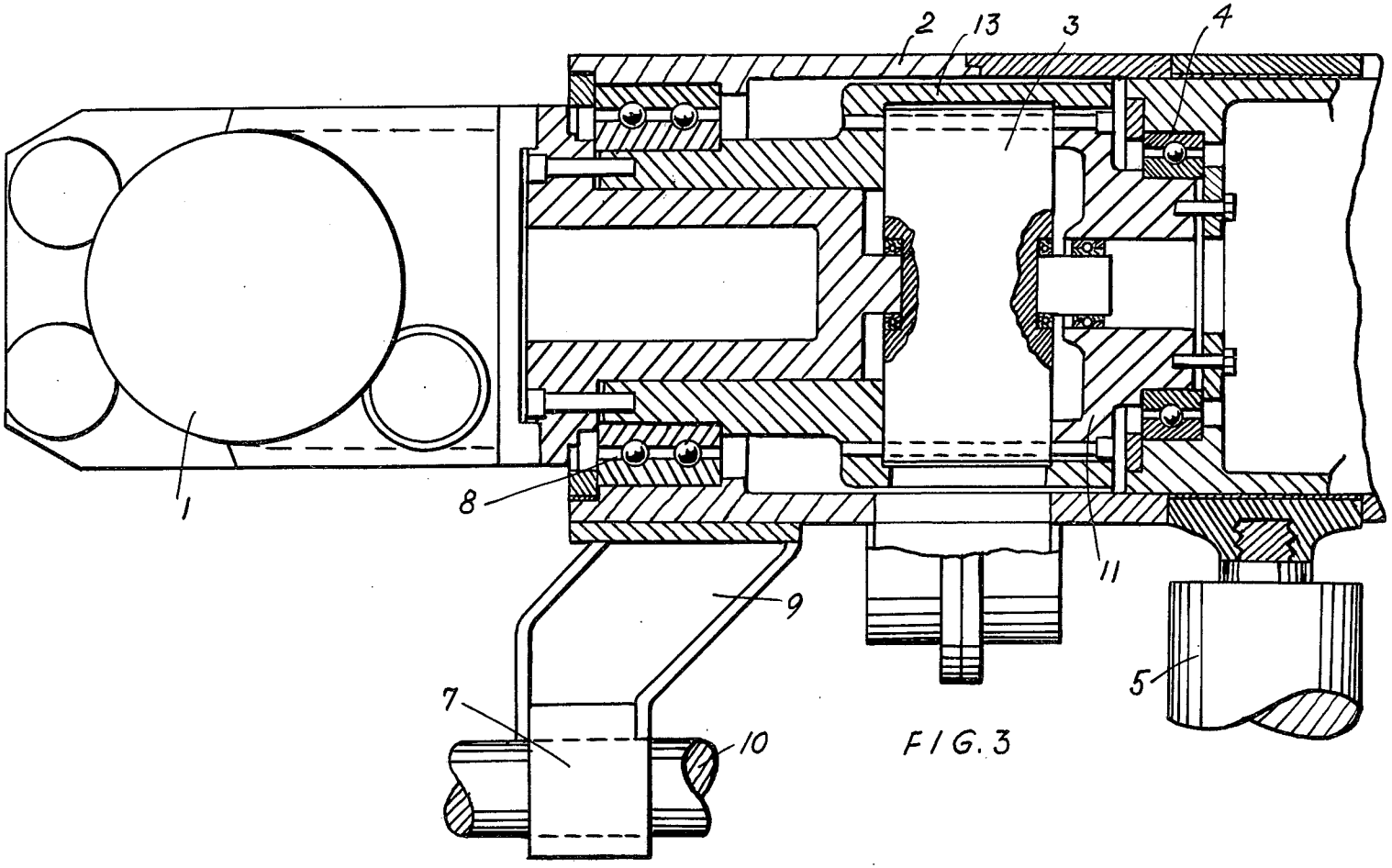
FIG. 3 is a section along the line III-III of FIG. 1.

The elevation of the weapons is effected with aiming drives 3 (FIG. 3) which are accommodated in the carrier 2 between a main support bearing 8 and a step bearing 4. The aiming drive transmits a torque to a journal 11 to which the weapon 1 is flanged. The aiming drive 3 is constructed so that while moving it is possible to stabilize the weapons in height and thus shen shooting.

The adjusting of the weapons is effected by an adjustment of the journal 11 in the step bearing 4. When an eccentrically formed bearing ring 13 of the step bearing 4 is rotated, the position of the journal 11 and thus the position of the weapon is altered. By this eccentric adjustment, both weapons are point-aimable to a predetermined distance.

The eccentric adjustment may be effected by a positioner drive. When the bearing ring 13 at one side is rotated, i.e. the one weapon maintains its base adjustment once set and the other weapon is adjusted relative to the carrier 2 through the intermediary of the journal 11, it is possible to point-aim the entire weapon system infinitely from short- to long-distance shots. The eccentric adjustment drive may be constructed as a worm drive. For a single base adjustment of the one weapon, the worm drive is operated manually. In case of an infinitely adjustable arrangement of the eccentric bearing ring 13 of the other weapon the worm drive may for instance be driven by an electrical positioning motor.

Figure 2:
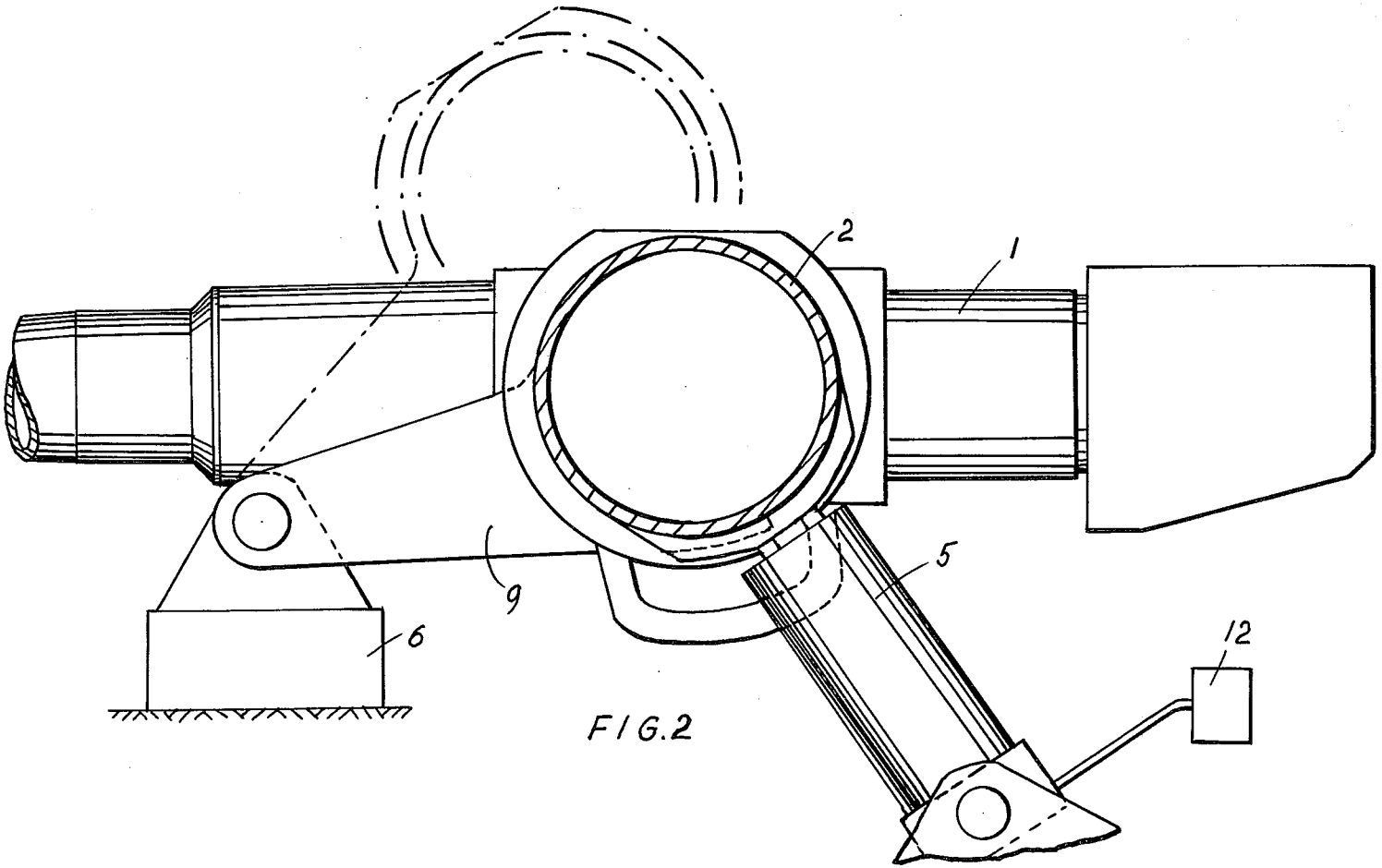
FIG. 2 is a section along the line II-II of FIG. 1.

The carrier 2 is pivoted upwardly around the axis 10 through the intermediary of two support arms 9 which are rigidly connected to the weapon carrier 2. A pivoting to the vehicle is effected through the intermediary of two resiliently constructed pivots 6 and 7. At the third bearing point of the weapon carrier 2, a hydraulic cylinder with a hydro-accumulator 12 arranged upstream thereof is connected (see FIG. 2). The hydraulic cylinder serves to lift the weapon carrier 2 and likewise defines a resilient pivot point upon rendering operative the hydro-accumulator 12. The resilient suspension of the weapon carrier 2 in three points insures that oscillations of the carriage are not transmitted to the weapon system, thereby an oscillation decoupling is achieved between the weapon carrier and the carriage.

The forces which must be received by the weapon carrier 2 and thus by the pivots 5, 6 and 7 upon firing may be reduced by the following measures:

An extension of the barrel return movement of both weapons linearly reduces the forces in relationship to the increase of movement. The loading is furthermore reduced when the weapon carrier 2 recoils after firing through the intermediary of the hydraulic cylinder and the hydro-accumulator 12.

A recoiling of the weapon carrier 2 means that the inertia of the system will become greater as a result of the carrier mass participating in addition to the return movement of the weapon masses, the reaction forces thereby being accordingly less.

The invention may be embodied in other specific forms without departing from the spirit or essential characteristics thereof. The embodiment is therefore to be considered in all respects as illustrative and not restrictive.

What is claimed is:

1. A system for mounting weapons on a combat vehicle with the weapons arranged to extend along the long sides of the vehicle, comprising a horizontal axially extending carrier arranged to extend transversely of the long sides of the combat vehicle, a pair of large-bore weapons each mounted on said carrier spaced from one another and extending transversely of the axis of said carrier, a pair of first pivots attached to said carrier, each of said first pivots located outwardly from said carrier in the direction extending transversely of the axis thereof, said first pivots defining an axis of rotation for said carrier with the axis located outwardly from said carrier, a second pivot attached to said carrier for lifting said carrier and pivoting said carrier around the axis of rotation formed by said first pivots, means for rotatably mounting each said weapon on said carrier, said means comprises a main support bearing positioned within said carrier, a step bearing positioned within said carrier and spaced from said main support bearing, a journal mounted in said main support bearing and said step bearing and flanged to one of said weapons, and said step bearing includes an eccentrically formed bearing ring for eccentrically adjusting said journal in said step bearing relative to said carrier.

2. A system as set forth in claim 1, wherein a support arm is attached to each said first pivot defining the axis of rotation of the carrier, and said support arms extend transversely of the axis of rotation and are connected to said carrier.

3. A system as set forth in claim 1, wherein said first and second pivots for pivoting the carrier are formed resiliently.

4. A system as set forth in claim 1, wherein means for lifting the carrier are connected to said second pivot, and said lifting means comprises a hydraulic cylinder.

5. A system as set forth in claim 4, including a hydro-accumulator connected to said hydraulic cylinder.

* * * * *